US005688211A

United States Patent [19]

Myers

[11] Patent Number: 5,688,211

[45] Date of Patent: Nov. 18, 1997

[54] COLLAPSIBLE CHILD EXERCISER DEVICE

[75] Inventor: Peter J. Myers, Wheaton, Ill.

[73] Assignee: Kolcraft Enterprises, Inc., Chicago, Ill.

[21] Appl. No.: 556,309

[22] Filed: Nov. 13, 1995

[51] Int. Cl.[6] ..... A63B 25/00; B62B 9/12

[52] U.S. Cl. ..... 482/66; 297/5; 482/77

[58] Field of Search ..... 482/66, 77, 78; 297/5, 344.26, 344.21; 280/87.03, 87.051

[56] References Cited

U.S. PATENT DOCUMENTS

| | | | |
|---|---|---|---|
| D. 295,397 | 4/1988 | Brownlie et al. . | |
| D. 315,644 | 3/1991 | White . | |
| 8,478 | 10/1851 | Rice . | |
| 149,178 | 3/1874 | Wright . | |
| 432,378 | 7/1890 | Davidson et al. . | |
| 517,403 | 3/1894 | Bradish et al. . | |
| 1,861,661 | 7/1932 | Huerlin . | |
| 2,812,012 | 11/1957 | Hansburg . | |
| 2,862,710 | 12/1958 | Lewis . | |
| 2,910,111 | 10/1959 | Hansburg . | |
| 2,978,243 | 4/1961 | Gabrielson . | |
| 2,988,358 | 6/1961 | Mills . | |
| 3,013,764 | 12/1961 | Kuhn . | |
| 3,030,949 | 4/1962 | Gassaway . | |
| 3,078,479 | 2/1963 | Grosse et al. . | |
| 3,425,709 | 2/1969 | Fields . | |
| 3,578,381 | 5/1971 | Young . | |
| 3,796,430 | 3/1974 | Sudo . | |
| 4,025,107 | 5/1977 | Chippa . | |
| 4,045,045 | 8/1977 | Boucher et al. . | |
| 4,084,273 | 4/1978 | Haynes . | |
| 4,141,588 | 2/1979 | Anderson . | |
| 4,160,553 | 7/1979 | Fleischer . | |
| 4,225,146 | 9/1980 | Takeuchi . | |
| 4,773,639 | 9/1988 | Graves . | |
| 4,822,030 | 4/1989 | Cone | 297/5 |
| 4,830,345 | 5/1989 | Mar . | |
| 5,178,438 | 1/1993 | Beger . | |
| 5,407,246 | 4/1995 | Meeker et al. . | |
| 5,433,682 | 7/1995 | Fermaglich et al. | 482/66 |
| 5,451,093 | 9/1995 | Petrie et al. | 482/66 |
| 5,480,210 | 1/1996 | Lehenbaur | 297/344.26 |
| 5,518,475 | 5/1996 | Garland | 482/66 |

OTHER PUBLICATIONS

Advertisement for Evenflo Exersaucer™ Exercise and Entertainment Centers, dated 1995.

*Primary Examiner*—Jerome Donnelly

*Attorney, Agent, or Firm*—Marshall, O'Toole, Gerstein, Murray & Borun

[57] ABSTRACT

A child exerciser device in which an integral seat and tray are adapted to bounce relative to a bouncer ring. The bouncer ring rotates relative to a cross piece member by means of a lazy susan mechanism. The cross piece includes pivotable legs which are adapted to be adjustably engaged in tubular members extending upward from a base member which allows the device to rock in only one back and forth direction. The top portion of the device is removable from the base member and can be disposed within the base member whereby the collapsed unit can be manually transported and stored.

16 Claims, 8 Drawing Sheets

COLLAPSIBLE CHILD EXERCISER DEVICE

BACKGROUND OF THE INVENTION

The invention disclosed and claimed herein relates generally to apparatus for a collapsible child exerciser, which, when assembled, permits a child seated in the device to exercise by bouncing and/or rocking the device.

DESCRIPTION OF THE PRIOR ART

There are presently available in the prior art various systems which permit a child to bounce, rotate and/or rock in various directions. An example of one such device is disclosed in U.S. Pat. No. 5,407,246. The device includes a seat which rotatably supports a tray whereby the tray rotates relative to the seat. The seat and tray also are adapted to bounce relative to a base support which is a bowl-shaped member which permits the device to rotate in any direction.

It has been found, however, that in various instances, it is not desired to have a child's seat rotate relative to the tray. Rather, it is desired to have the tray and seat rotate as one integral unit relative to the base so that items located in the tray, such as children's toys, always are located in front of the infant seat.

Further, the prior art device is adapted to rock in any direction. It is desirous to have a device which is adapted to rock only in one, back and forth direction.

It also is desirous to have the unit collapsible so that, in a collapsed position, the unit is reduced in size with the upper portion of the device collapsed within the base whereby the unit can be manually transported and stored relatively easily.

What is desired is to have a child exerciser device which includes an integral seat and tray whereby the seat does not rotatably support the tray. The seat and tray are adapted to rotate simultaneously about a base, the latter being adapted to rock back and forth in one direction. The unit also should be collapsible whereby the seat and tray can be stored within the base whereby, in a collapsed position, the unit can be transported and stored relatively easily in its collapsed position.

SUMMARY OF THE INVENTION

The invention disclosed and claimed herein serves to obviate problems associated with the prior art while at the same time achieving the desired advantages sought for a child support device.

Briefly, the child exerciser device of the present invention comprises a seat support member and tray which are molded together to form an integral one-piece member. A cloth or vinyl seat is disposed or otherwise fastened to the seat support member. The seat-tray member is resiliently seated on a bouncer ring member located below the seat and tray. The bouncer ring member is rotatably mounted on a plurality of ball bearings which, in turn, are located in a bearing retaining ring. The bearing retaining ring is disposed on a cross support member.

The cross support member includes a plurality of spaced, hinged, pivotable leg members which depend from the cross support member.

The base member includes a plurality of spaced, vertical tubular members which extend upwardly from the sides of the base. Each tubular member is adapted to releasably and adjustably receive a leg member. The base member also includes a lower curved surface which permits the base member to rock only in one back and forth direction, much like occurs with a rocking chair.

In use, a child is placed in the seat which is always in a fixed position relative to the tray. The child seat and tray rotate together as a single unit relative to the base member. Similarly, the seat and tray are adapted to bounce together as a unit relative to the cross piece member. The device also is adapted to rock back and forth in one direction. If desired, stop members can be employed to preclude rocking.

When it is desired to transport and/or store the unit, the leg members are initially removed from the base tubular members. They then are pivoted to a position beneath the cross support member. The collapsed upper portion of the device then is disposed within the base member whereby the collapsed assembly can be relatively easily transported and stored in the collapsed position.

DETAILED DESCRIPTION

Figure 1:
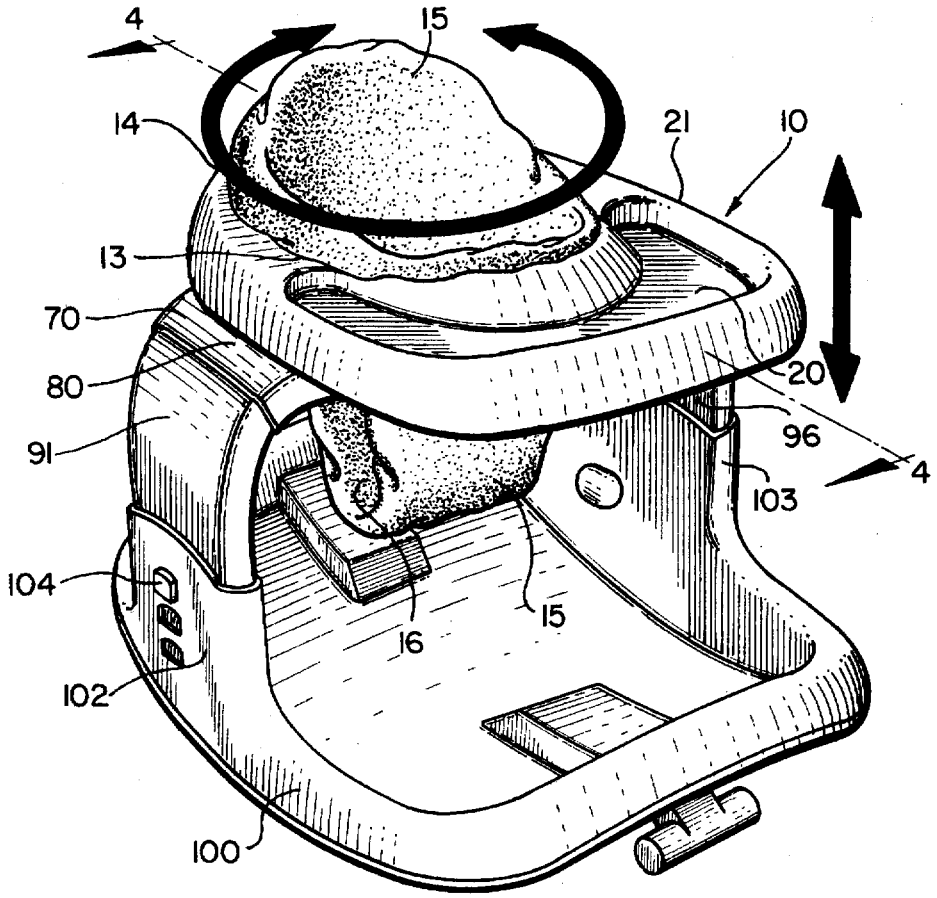
FIG. 1 shows a perspective view of the child exerciser device of the present invention in an assembled, non-rock position.
Figure 2:
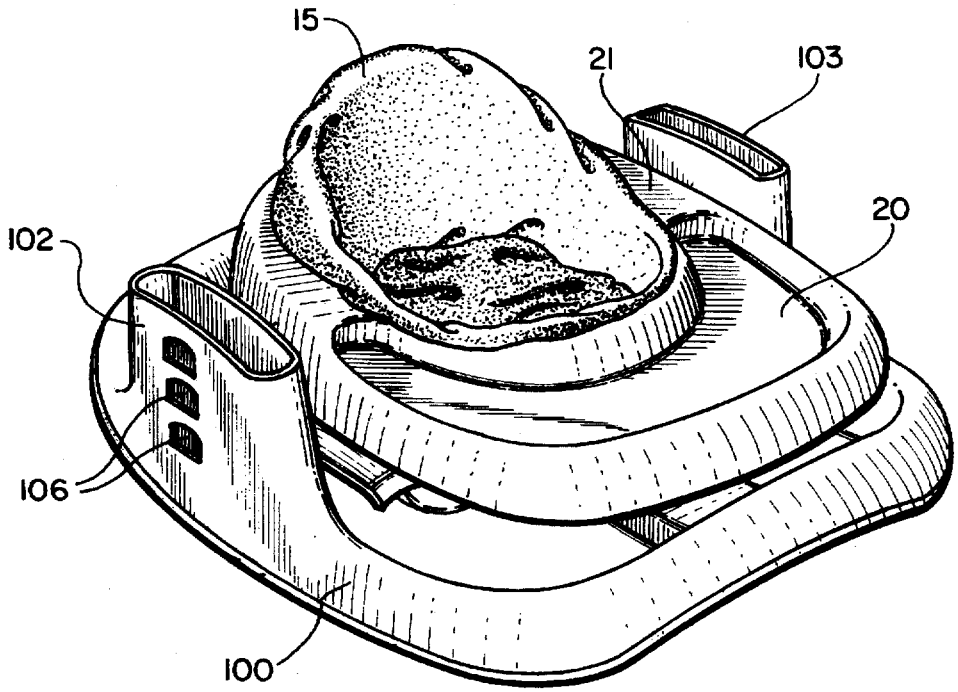
FIG. 2 shows the child exerciser device of the present invention with the collapsed top portion of the device disposed within the base member.

Referring to the drawings, e.g., FIGS. 1, 4, 5, and 7, there is shown child exerciser device 10. Device 10 includes seat support 12 which includes front 13 and rear 14 which define an opening for receipt of a cloth or vinyl flexible seat 15, which overlaps the seat support. Seat 15 includes a pair of openings 16 for receipt of the feet of a child placed in the seat.

Tray 20 is disposed adjacent seat front 13. Tray 20 and seat support 12 preferably are a one-piece molded polypropylene member 21 with the tray being constantly positioned in front of the seat support so that toys or other materials placed in tray 20 always remain in front of a child seated in the exerciser device.

Figure 3:
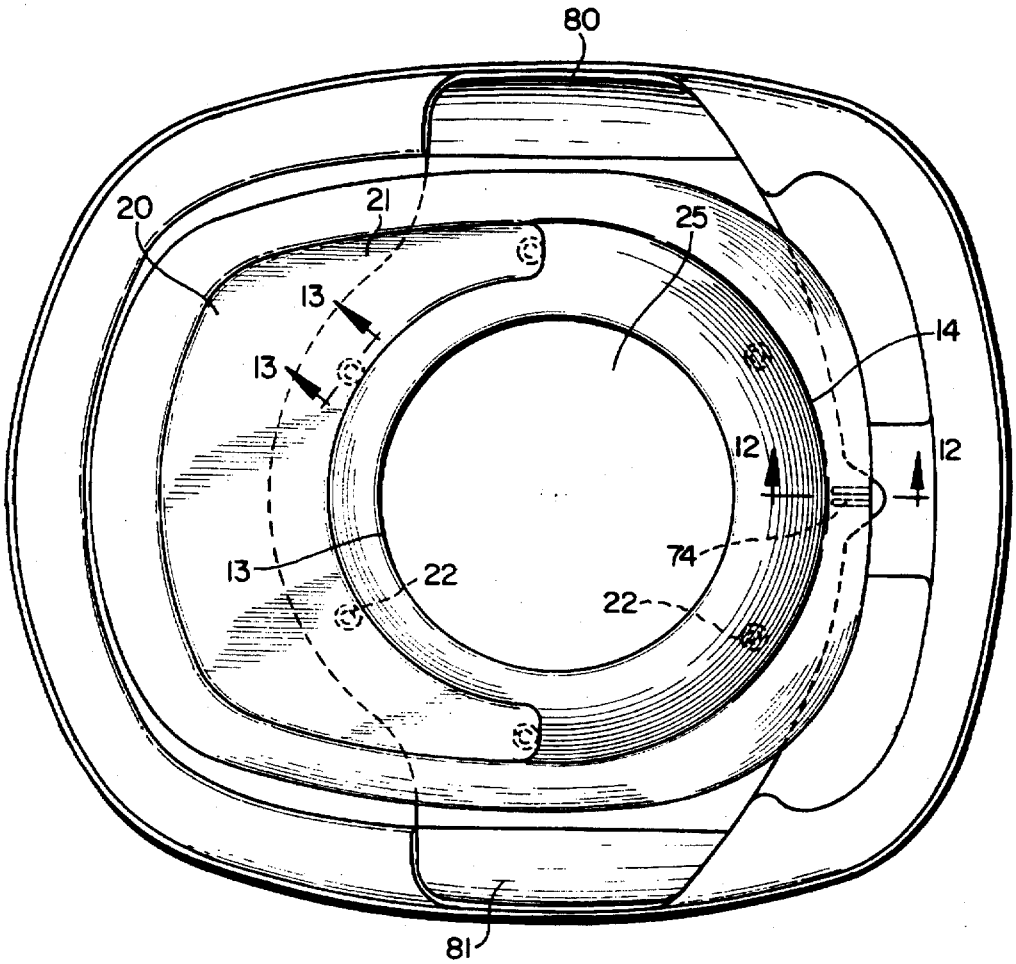
FIG. 3 shows a top plan view of the child exerciser device of the present invention.

A plurality of spaced, cylindrical posts 22 are molded to and depend from the bottom surface of bottom wall 24 of tray/seat support member 21. Posts 22 preferably are located adjacent circular wall 23 which forms seat opening 25 (FIG. 3). Also depending from the surface of bottom wall 24 are a first, outer annular ring 26 and a second, inner annular ring 27 which form annular space 28 between the annular rings. A compression spring 29 is slipped over and surrounds each cylindrical post 22.

Bouncer ring 40 is disposed below seat/tray member 21. Bouncer ring 40 includes a first annular ring 41 and a second annular ring 42 spaced inwardly from the first annular bouncer ring.

A circular horizontal shelf 43 is spaced inwardly from the top 44 of the bouncer ring, the shelf extending around the outer periphery of bouncer ring 40.

Figure 12:
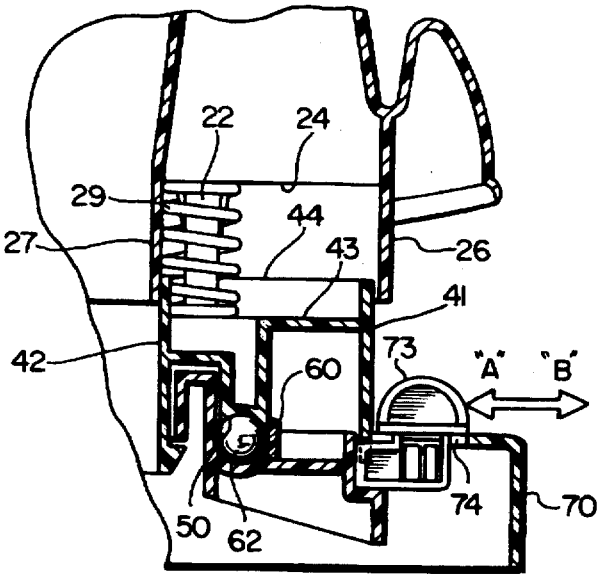
FIG. 12 is a fragmentary side section view taken along lines 12—12 in FIG. 3, showing the latching of the seat support to the bouncer ring.

When seat/tray member 21 is disposed on bouncer ring 40, annular ring 26 is adjacent the outer surface of bouncer annular ring 41 and inner tray/support annular ring 27 is adjacent the inner surface of bouncer annular ring 42, as seen more clearly in FIG. 12.

Figure 13:
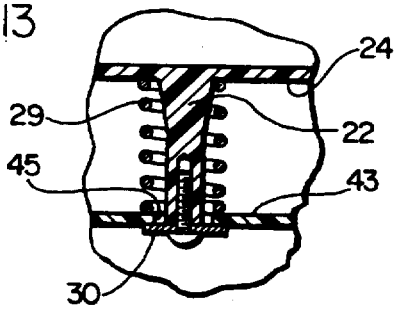
FIG. 13 is a fragmentary side section view taken along lines 13—13 in FIG. 3 showing a seat support post in an unloaded condition.
Figure 14:
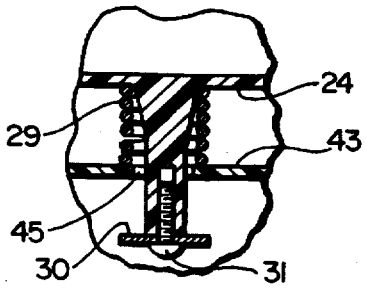
FIG. 14 is the fragmentary section view of FIG. 13 showing a seat support post in a loaded compressed condition.

Each post 22 extends through an opening 45 in shelf 43. Washer 30, which has a diameter greater than the diameter of shelf opening 45, is placed adjacent the lower surface of shelf 43. Threaded fastener 31 fastens washer 30 to the end of cylindrical post 22. Washer 30 precludes seat/tray member 21 from separating from bouncer ring 40. When a child is disposed in seat 15, springs 29 will compress either from the weight of a child or the bouncing action of a child. In a load condition, as seen in FIG. 14, compression spring 22 is compressed between wall 24 and shelf 43 and post 22 travels further through opening 45. As the load is released or relaxed, as illustrated in FIG. 13, wall 24 moves away from bouncer ring shelf 43 until washer 30 abuts the lower surface of shelf 43. Thus, the seat support and tray member 21 moves relative to bouncer ring 40 as a child bounces in the unit.

Figure 11:
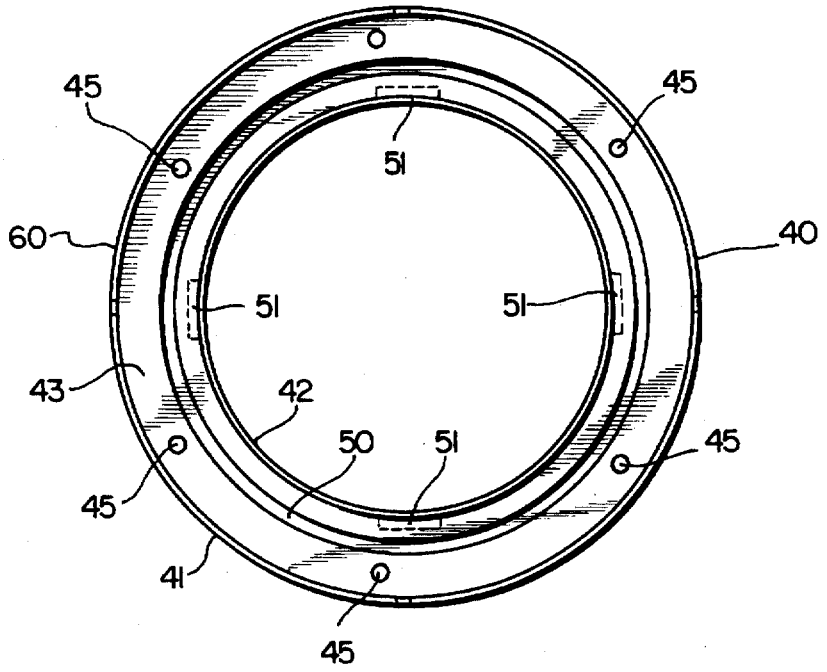
FIG. 11 shows a plan view of the bouncer ring.
Figure 16:
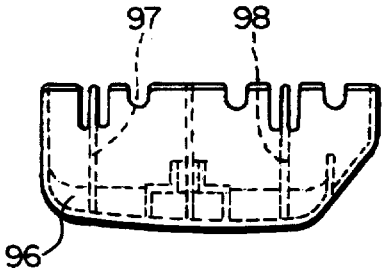

Bouncer ring 40, FIG. 11, also includes an upper circular race 50 which is formed in the ring between annular rings 41, 42. Race 50 is a circular member. Finally, bouncer ring 40 includes a plurality of spaced snap latches 51, each latch comprising a J-shaped hook 52. Latches 51 will be discussed hereafter.

Figure 10:
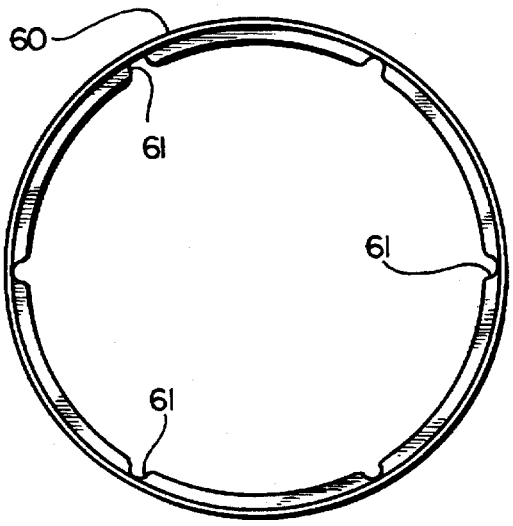
FIG. 10 shows a plan view of the ball bearing retaining ring.

Ball bearing retaining ring 60, FIG. 10, is disposed below bouncer ring 40. Ring 60 includes a plurality of spaced circular notches 61. Ball bearings 62 are adapted to be located in notches 61 of retaining ring 60.

Cross piece support member 70 having a circular opening 69 is disposed beneath ball bearing retaining ring 60. Cross piece 70 includes lower race 71, circular wall 72 and a latch member 73 which is disposed in slot 74.

In assembly, ball bearings 62 are placed in support member race 71 and notches 61 of ball bearing retaining ring 60. Bouncer ring upper race 50 is placed over ball bearings 62 with bouncer ring 40 being positioned over cross piece 60 so that wall 42 is adjacent the inner surface of cross piece wall 72. J hook snap locks 52 snap into place against wall surface 75. Assembled in this position, bouncer ring 40 is locked to cross piece 70 and is adapted to rotate in a lazy susan movement relative to the cross piece.

If it is desired to preclude rotation of bouncer ring 40 relative to cross piece 70, latch member 73 is pushed forward in the direction of arrow "A" (FIG. 12). The latch member travels in slot 74 until member 73 abuts bouncer ring wall 41. When rotation is desired, latch member 73 is pulled in the direction of arrow "B" (FIG. 12) such that latch member 73 does not interfere with the rotation of bouncer ring 40 relative to cross piece 70.

Figure 4:
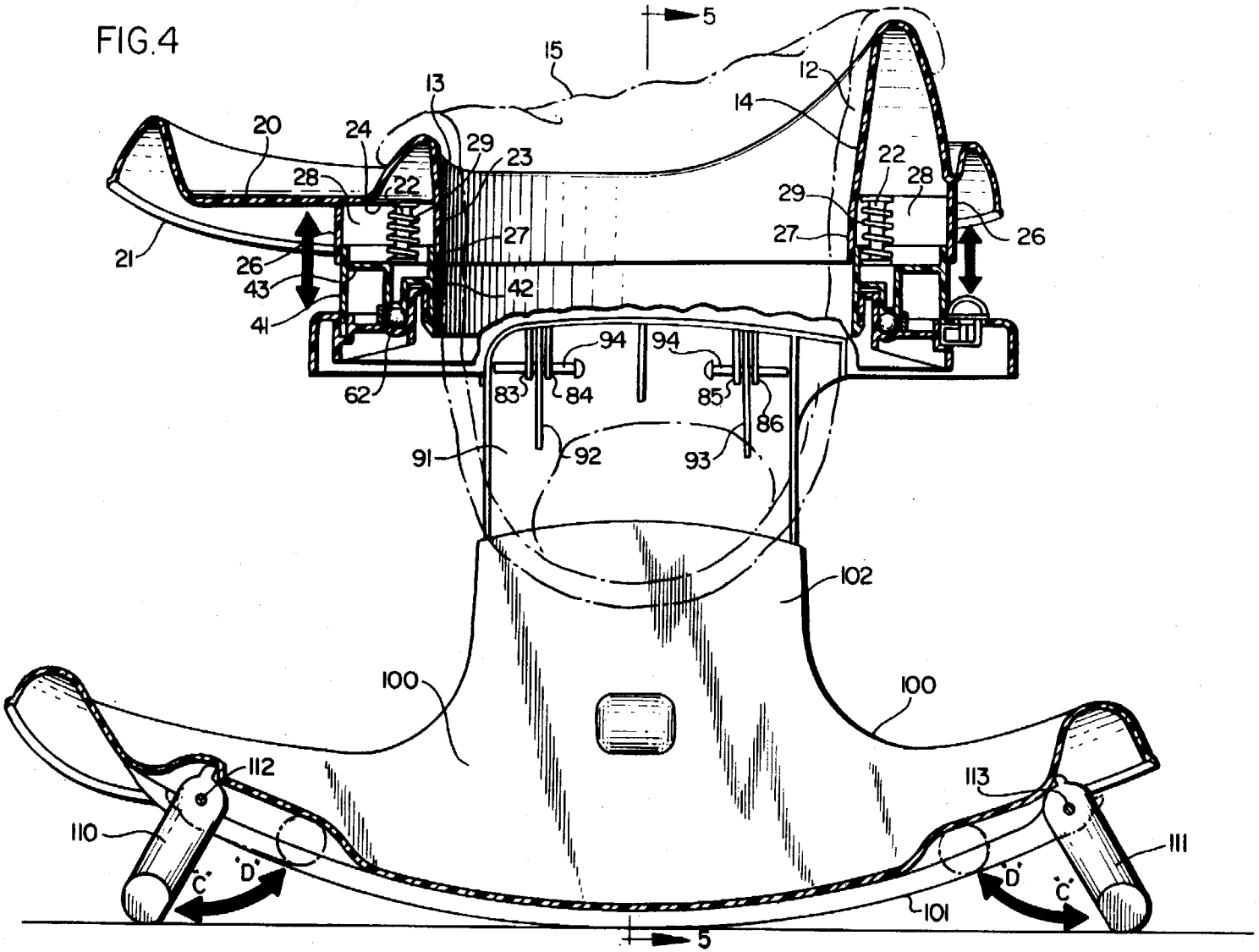
FIG. 4 shows a side section view of the child exerciser device taken along lines 4—4 of FIG. 1.
Figure 5:
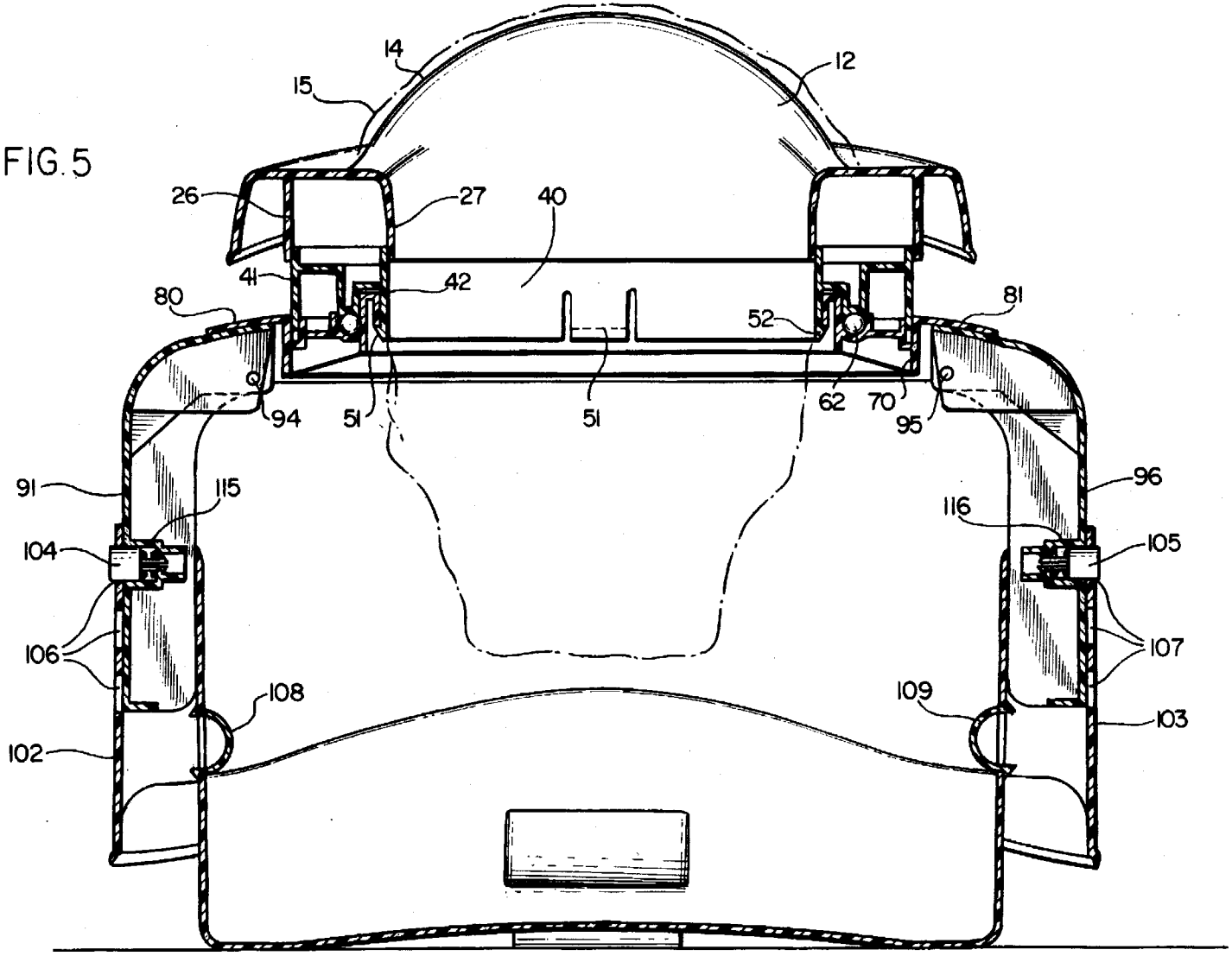
FIG. 5 shows a front section view of the child exerciser device taken along lines 5—5 in FIG. 4.
Figure 9:
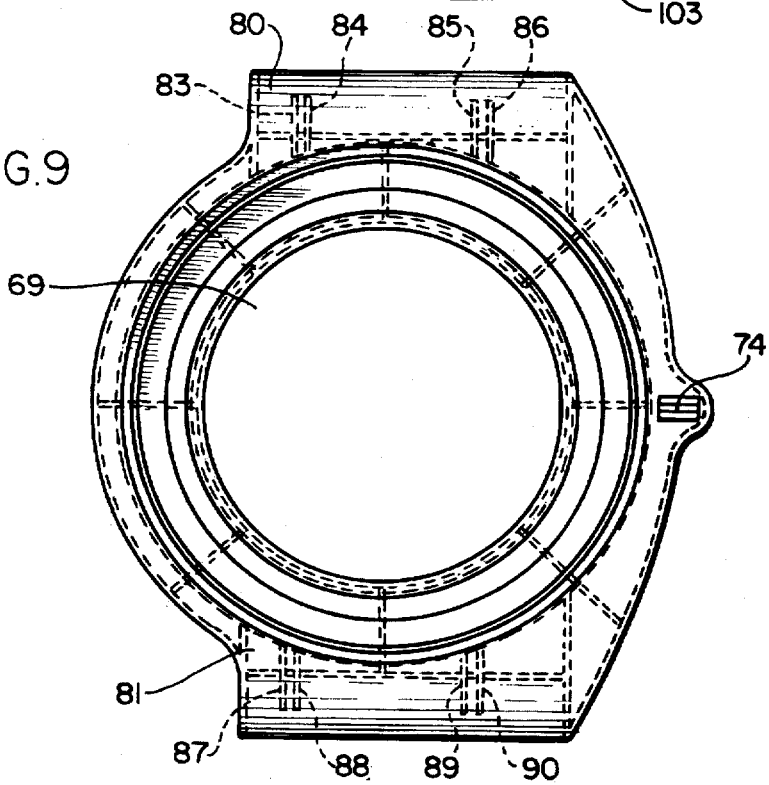
FIG. 9 shows the bouncer ring and retaining ring disposed on the cross support member.
Figure 15:
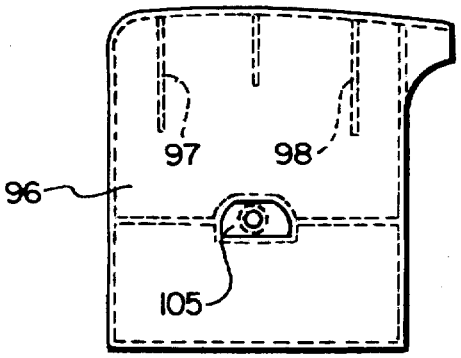
FIG. 15 shows a side view of a cross piece leg member with a biased adjusting button disposed therein; and, FIG. 16 shows a plan view of a cross piece leg member.

Turning to FIGS. 4, 5, and 9, cross piece 70 includes a pair of oppositely spaced hinge members 80, 81. Member 80 includes two pairs of spaced ribs 83, 84 and 85, 86. Member 81 also includes two pieces of spaced ribs 87, 88 and 89, 90. Leg 91, which is hinged to member 80 includes ribs 82, 83 (FIGS. 4, 15). Pivot pin 94 connects member 80 and leg 91 as it is passed through openings in ribs 83 and 84 in hinge member 80 and an opening in rib 92 which extends out from leg 91. Another pivot pin 94 passes through openings in ribs 85, 86 located on hinge member 80 and an opening in rib 93 located on leg 91 such that leg member 91 is pivotally fastened to cross piece hinge member 80 by the two pins 94 (FIG. 4).

Leg member 96 (FIG. 15, 16) includes ribs 97, 98. A first pivot pin 95 (FIG. 5) passes through openings 87, 88 in hinge member 81 and an opening in rib 97 located on leg member 96. Another pivot pin passes through openings 89, 90 in hinge member 81 and an opening in rib 98 located on leg member 96 such that leg member 96 is pivotally connected to cross piece hinge member 81.

Base support member 100 has a curved bottom surface 101 which permits device 10 to rock in only one back and forth direction. A pair of spaced upright tubular members 102, 103, which are molded to base support member 100, are located adjacent opposed edges.

Leg 91 is adapted to be received with tubular member 102 whereas leg 96 is adapted to be received within tubular member 103.

Button member 104, which is located on leg 91, is biased by compression spring 115 outwardly away from the device. It is adapted to be inserted in one of a number of spaced openings 106 in tubular member 102. In a like manner, button member 105 located on leg 96, which also is normally biased by compression spring 116 outwardly away from the device, is adapted to engage one of a number of spaced openings 107 in tubular member 103.

The inner wall of tubular member 102 includes detent 108 which extends outwardly from the wall. Similarly, the inner wall of tubular member 103 includes detent 109 which extends outwardly away from the wall.

Figure 6:
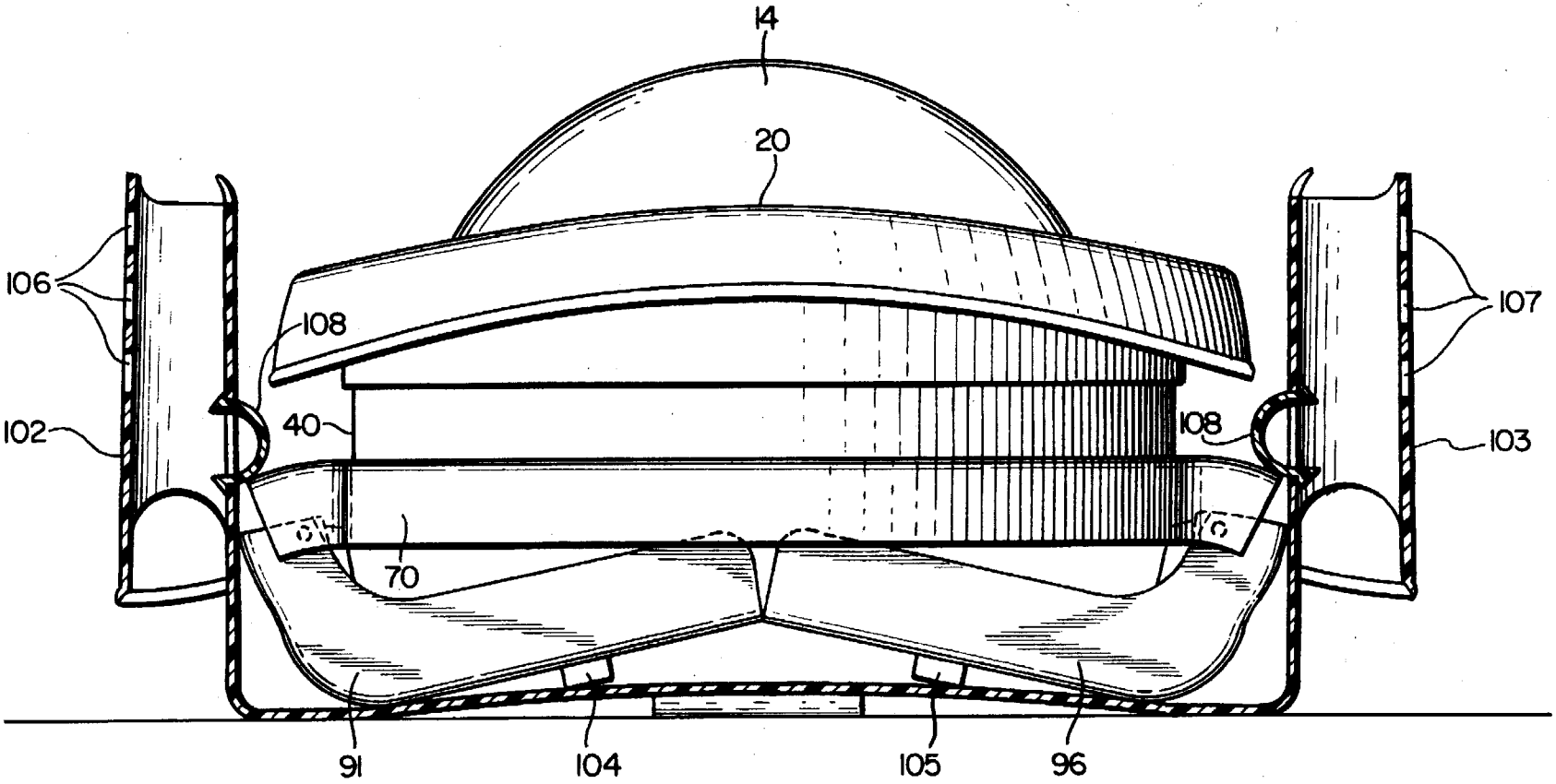
FIG. 6 shows the child exerciser device of FIG. 2 with various components thereof in a collapsed position.
Figure 7:
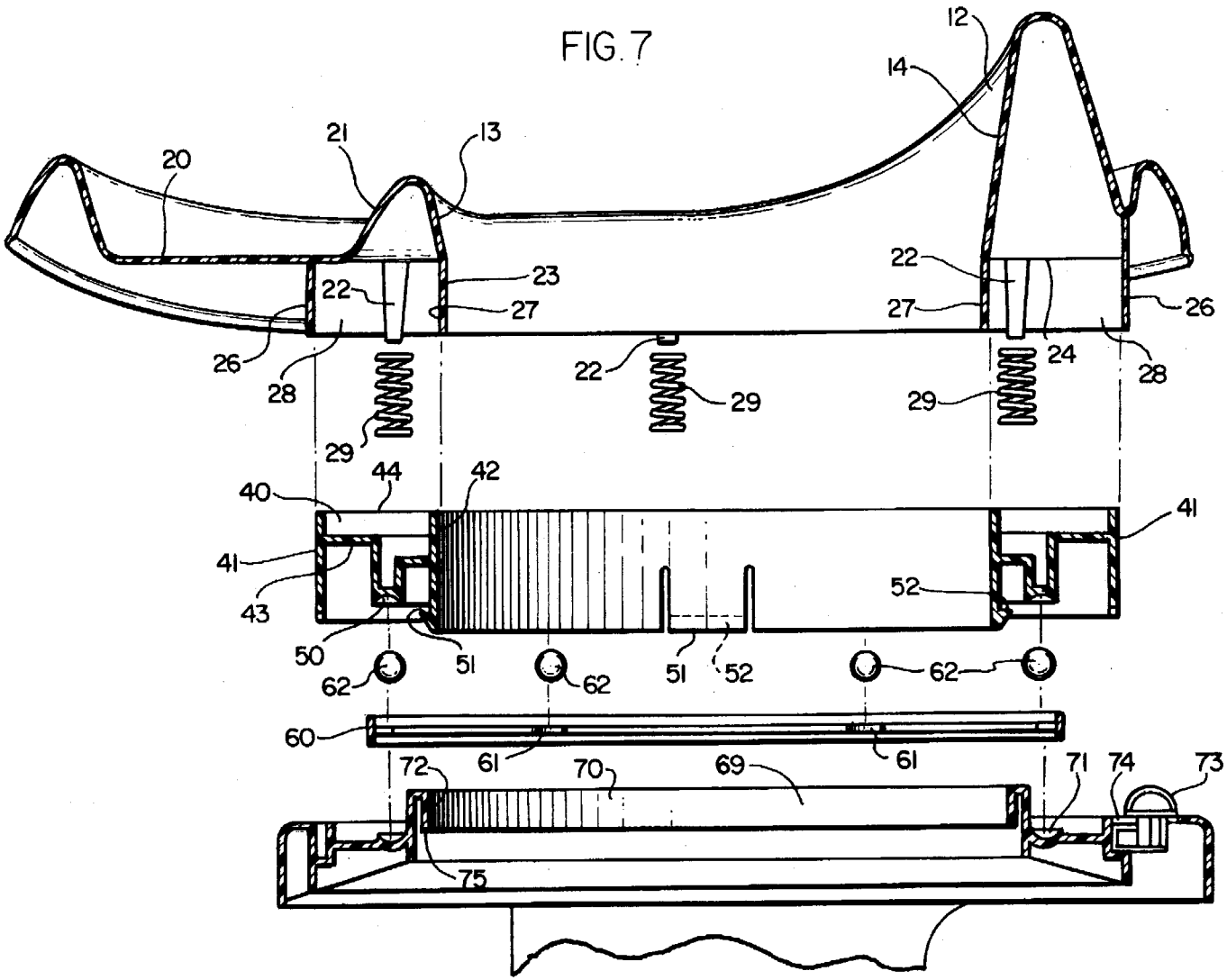
FIG. 7 shows various components of the child exerciser device disassembled.
Figure 8:
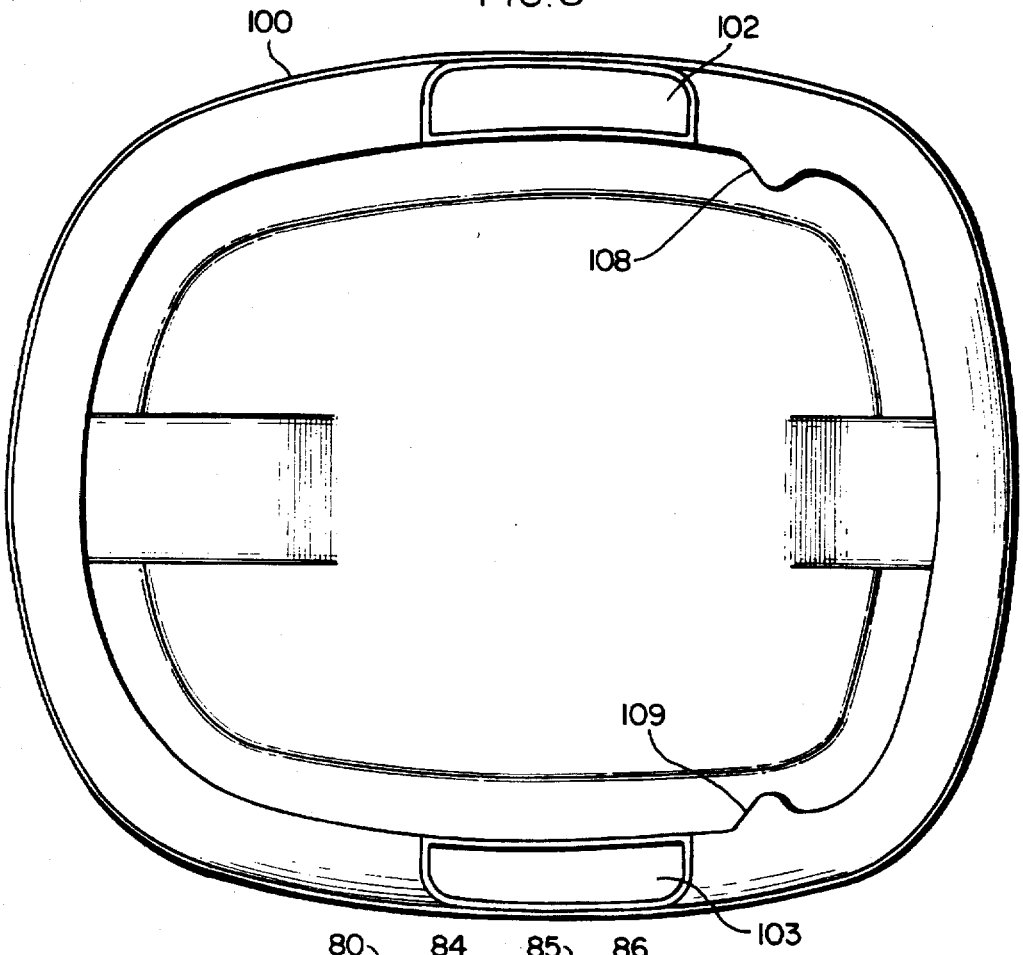
FIG. 8 shows a plan view of the base member of the child exerciser.

When it is desired to collapse child exerciser device 10, button members 104, 105 are pushed inwardly to pass the button member through respective openings 106, 107 whereupon the upper portion of device 10 can be withdrawn from the base support tubular members 102, 103. Legs 91 and 96 can be pivoted as shown, for example, in FIG. 6, whereby they fold inwardly and under cross piece 70. The child support portion of device 10, i.e., seat support 12, tray 20, bouncer ring 40, and cross piece 70, then is deposited in base support member 10 with detents 108, 109 abutting hinge members 80, 81 in a compressed manner to maintain the support portion within base member 100. The collapsed device 10 then can be manually transported and stored.

If desired, pivotable stop members 110, 111 can be pivotally connected at 112, 113 on the bottom of base support member 100. By pivoting a stop member in the direction of arrow "C," the stops are placed in a position as shown in FIG. 4 which serves to preclude the device from rocking. To return to a rocker mode, the stops are pivoted in the direction of arrow "D" in FIG. 4 where they can be retained in place by any suitable means.

While the present invention has been described in connection with a single embodiment, it will be understood to those skilled in the art that many changes and modifications may be made without departing from the true spirit and scope of the invention. It is therefore intended by the appended claims to cover all such changes and modifications which come within the true spirit and scope of the invention.

What is claimed is:

1. A child exerciser device comprising:

a seat support having a front and back and an opening therein;

a tray integrally joined to the front of said seat support;

a plurality of spaced post means depending from said seat support;

biasing means disposed on said post means;

a bouncer ring disposed below said seat support, said bouncer ring including an opening therein, a circular shelf having a plurality of spaced openings and an upper race;

each of said posts extending through one of said shelf openings;

means for connecting said seat support to said post at the location of said posts whereby said seat support is biased away from said bouncer rings;

a cross piece member disposed below and connected to said bouncer ring, said cross support member including a lower race;

ball bearings disposed within said lower and upper races whereby said bouncer ring is adapted to rotate relative to said cross piece member;

spaced leg members each pivotally connected to and manually depending from said cross piece member, said leg members including means for pivoting said leg members beneath said cross piece member;

a base support member disposed below and spaced from said cross piece member;

spaced tubular member extending upwardly from said base member; and, each of said hinged leg members being releasably received within one of said tubular members.

2. A child exerciser device in accordance with claim 1 and further including a ball bearing retaining ring disposed between said bouncer ring and said cross piece member, said retaining ring having notches therein for receiving a ball bearing located in said races.

3. A child exerciser device in accordance with claim 1 wherein said biasing means include compression springs mounted on said posts.

4. A child exerciser device in accordance with claim 1 and further including a biased button means for releasably connecting one of said tubular members to one of said cross piece leg members.

5. A child exerciser device in accordance with claim 1 wherein said cross piece includes an opening therein and a flexible seat is disposed over said seat support and extends through openings in said seat support bouncer ring and cross piece member.

6. A child exerciser device comprising:

a seat support having an opening therein;

a tray member permanently fixed to the front of said seat support;

a bouncer ring having an opening therein, said ring being adjacent said seat support;

means for resiliently connecting said bouncer ring to said seat support;

a cross piece member disposed below said bouncer ring;

said bouncer ring and cross piece member each including a race for receipt of bearing means whereby said bouncer ring rotates relative to said cross piece member; and, a base member releasably hinged to said cross piece member whereby said cross piece member, bouncer ring and seat support are adapted to be disconnected from and stored in said base member.

7. A child exerciser device in accordance with claim 6 wherein said seat support means includes a plurality of spaced posts depending from said support; and, said resilient means including spring means disposed on said posts, said seat support and said bouncer ring being connected together at the location of said posts.

8. A child exerciser device in accordance with claim 7 wherein said posts are located contiguous to said seat support opening.

9. A child exerciser device in accordance with claim 7 and further including a bearing retaining ring disposed between said bouncer ring race and said cross piece member.

10. A child exerciser device in accordance with claim 9 in which said bearing retaining ring includes a plurality of notches therein for receipt of ball bearings.

11. A child exerciser device in accordance with claim 6 wherein said cross piece member includes a plurality of spaced leg members hinged to and normally depending from said cross piece member; and, said base support member includes a plurality of spaced tubular members, each of said tubular members receiving one of said leg members; and, means for releasably connecting said leg member to the tubular members whereby upon release of said leg members from said tubular members, said leg members may be pivoted to a position below said cross piece member.

12. A child exerciser device in accordance with claims 1 or 6 and further including detent means disposed in said base support member for contacting said removed portion of said device following its removal from said base support member and placement in said base support member.

13. A child exerciser seat device comprising:

a seat support member having a front and back and an opening therein;

a tray permanently fixed to the front of said seat support member;

a plurality of spaced post means depending from said seat support and positioned contiguous to said seat support opening;

biasing means associated with said post means;

a bouncer ring having an opening therein positioned adjacent said seat support member;

means connecting said biased post means to said bouncer ring for permitting resilient movement between said bouncer ring and seat support member;

a cross piece member having an opening therein joined to said bouncer ring;

bearing means disposed between said bouncer ring and said cross piece member for permitting rotation of said bouncer ring relative to said cross piece member; and, a base member spaced from and connected to said cross piece member.

14. A child exerciser device in accordance with claim 13 wherein said cross piece member includes a plurality of spaced legs having two ends, one of said leg ends being pivotally connected to said cross piece member whereby said legs can be collapsed under said cross piece member;

said base support member including a plurality of spaced tubular members;

each of said remaining leg ends being releasably disposed in one of said tubular members.

15. A child exerciser device in accordance with claim 14 and further including means for adjusting the position of said cross piece legs with respect to said tubular members.

16. A child exerciser device in accordance with claims 1, 6, or 13 wherein said base member has a curved surface for contact with the ground wherein said curve is shaped to permit rocking of said device in only one back and forth direction.

* * * * *